US008998685B2

(12) United States Patent
Klabunde et al.

(10) Patent No.: US 8,998,685 B2
(45) Date of Patent: Apr. 7, 2015

(54) GRINDER HAVING DUST EXTRACTION SYSTEM

(75) Inventors: Olaf Klabunde, Giengen (DE); Heinrich Weber, Schwaebisch Gmuend (DE)

(73) Assignee: C. & E. Fein GmbH (DE)

( * ) Notice: Subject to any disclaimer, the term of this patent is extended or adjusted under 35 U.S.C. 154(b) by 577 days.

(21) Appl. No.: 13/306,622

(22) Filed: Nov. 29, 2011

(65) Prior Publication Data

US 2012/0135671 A1 May 31, 2012

(30) Foreign Application Priority Data

Nov. 29, 2010 (DE) ..... 10 2010 053 424

(51) Int. Cl.
*B24B 27/08* (2006.01)
*B24B 55/10* (2006.01)

(52) U.S. Cl.
CPC ..... *B24B 55/10* (2013.01)

(58) Field of Classification Search
CPC ..... B23D 59/006; B24B 55/06; B24B 55/10; B24B 55/102
USPC ..... 451/358, 451, 453, 456
See application file for complete search history.

(56) References Cited

U.S. PATENT DOCUMENTS

| | | | | |
|---|---|---|---|---|
| 1,811,577 | A * | 6/1931 | Crowe | 30/391 |
| 3,382,578 | A * | 5/1968 | Dobbertin | 30/391 |
| 3,585,980 | A * | 6/1971 | Mellor | 125/13.01 |
| 4,022,182 | A * | 5/1977 | Lenkevich | 125/13.01 |
| 5,440,815 | A * | 8/1995 | Inkster | 30/390 |
| 5,833,524 | A | 11/1998 | Satoh et al. | |
| 5,887,497 | A * | 3/1999 | Ensz | 81/484 |
| 7,197,826 | B2 * | 4/2007 | Baxivanelis et al. | 30/124 |
| 7,223,163 | B2 * | 5/2007 | Neumeier et al. | 451/451 |
| 7,300,339 | B2 * | 11/2007 | Gaul et al. | 451/451 |
| 7,854,649 | B2 | 12/2010 | Bohne et al. | |
| 8,070,845 | B2 * | 12/2011 | Roehm | 55/385.1 |
| 2007/0251104 | A1 | 11/2007 | Heinrichs et al. | |
| 2008/0163492 | A1 * | 7/2008 | Johansson | 30/124 |

FOREIGN PATENT DOCUMENTS

| | | | |
|---|---|---|---|
| DE | 19549335 | A1 | 8/1996 |
| DE | 10357841 | A1 | 7/2005 |
| DE | 202006016185 | U1 | 3/2007 |
| DE | 102006000200 | A1 | 10/2007 |
| EP | 1778437 | B1 | 3/2009 |

* cited by examiner

*Primary Examiner* — Lee D Wilson
*Assistant Examiner* — Tyrone V Hall, Jr.
(74) *Attorney, Agent, or Firm* — St. Onge Steward Johnston & Reens LLC

(57) ABSTRACT

Disclosed is a grinder, in particular an oscillating grinder, having a grinding spindle, to which a grinding tool can be attached, and having a housing, and having a dust extraction duct which can be attached to the housing by means of a pivot joint and a latching connection.

14 Claims, 3 Drawing Sheets

GRINDER HAVING DUST EXTRACTION SYSTEM

CROSSREFERENCES TO RELATED APPLICATIONS

This application claims priority from German patent application 10 2010 053 424.2, filed on Nov. 29, 2010. The entire contents of this priority application is incorporated herein by reference.

BACKGROUND OF THE INVENTION

The invention relates to a grinder, in particular an oscillating grinder, having a grinding spindle, to which a grinding tool can be attached, and having a housing, which has a first region that faces towards the grinding spindle and has a second region that faces away from the same, and having a dust extraction duct.

Such a grinder is known from EP 1 778 437 B1.

In the case of the known grinder, a dust extraction duct is integrated into the housing, at the lower end of the housing, and opens into an annular region around the grinding spindle.

Although such a grinder does have an effective means of extracting grinding dust, a frequent requirement is the ability to work either with or without an extraction duct, depending on the intended application.

Known from DE 10 2006 000 200 A1 is a hand-held electric saw having a reciprocating saw blade provided with an extraction device that is optionally attachable to the saw housing.

Such an arrangement, however, does not provide any indication of how a removable extraction device could be accommodated on a grinder.

SUMMARY OF THE INVENTION

In view of this, it is a first object of the invention to disclose a grinder that has a dust extraction duct and that can be operated optionally either with or without the dust extraction duct.

It is a second object of the invention to disclose a grinder that has a removable dust extraction duct and that has a simple design allowing an easy operation.

These and other objects according to one aspect are achieved by a grinder, comprising:

- a grinding spindle configured for attaching a grinding tool;
- a housing having a first region that facing towards the grinding spindle and having a second region faces away from said grinding spindle;
- a dust extraction duct; and
- a first releasable connection between said housing and said dust extraction part allowing securing of said dust extraction part to said housing when being in a first position and allowing removal of said dust extraction part when being in a second position;

wherein said releasable connection comprises a pivot joint.

The object of the invention is thereby achieved. Since the dust extraction duct can be attached to the housing by means of a pivot joint and a connection that is releasable without any tool, fastening to the housing is effected in a rapid and simple manner.

The connection that is releasable without any tool is preferably configured as a latching connection in this case.

Since the latching connection is preferably configured as a releasable connection, the dust extraction duct can also be easily removed again, after release of the latching connection, without any tool being required for this purpose.

In a further embodiment of the invention, at least one recess, into which a pivot of the dust extraction duct can be inserted, is provided on the second region of the housing.

In this way, the dust extraction duct can first be fastened, by its pivot, in the at least one recess of the housing and then fixed to the housing by closure of the latching connection. Conversely, the dust extraction duct is easily removed from the grinder after the latching connection has been released.

According to a further embodiment of the invention, the at least one recess is realized in such a way that the pivot can be inserted, in one assembly position only, into the at least one recess and, upon being swivelled into a working position, is fixed in position in the at least one recess.

For this purpose, for example, the pivot can be designed as a flat pivot, to which there is assigned, on the housing, at least one recess having an insertion slot.

In this way, the dust extraction duct can easily be inserted, by its pivot, into the at least one recess without the aid of a tool and, after being swivelled out of the assembly position into the working position, can be fixed in position in the at last one recess.

Because of the use of an insertion slot in combination with a flat pivot, it is particularly easy to realize insertion in a particular angular position, and then to effect fixing in position by turning.

In a further embodiment of the invention, two recesses are provided opposite one another on the second region of the housing, the pivot having two pins, which can be inserted into the recesses.

This measure enables the pivot joint to be realized in a particularly simple manner, even in the case of a longitudinally divided housing.

As already mentioned, the housing of the grinder can be divided in the longitudinal direction into two housing halves, the two housing halves having a screwed connection that extends through a recess on the one housing half into the other housing half.

In this way, the pivot joint for detachably fastening the dust extraction duct can be realized in a simple manner in the region of a screwed connection, which is necessary in any case, between the two housing halves.

The screwed connection in this case can be realized in the axial direction of the pivot joint, such that the screwed connection can also be used, if necessary, as a pivot joint.

In an additional development of the invention, the dust extraction duct, upon being swivelled out of an assembly position, latches into a working position on the housing.

Fastening to the housing is thus ensured in a simple and secure manner.

In a further embodiment of the invention, on the tool side the dust extraction duct has an intake region that surrounds the grinding spindle.

This provides for an effective intake of grinding dust in the region of the grinding spindle.

In an additional development of this design, the intake region surrounds the grinding spindle annularly between the housing and a grinding tool fastened to the grinding spindle.

The intake region in this case preferably has an annular intake opening that faces towards the grinding tool.

This provides for an effective intake immediately in the region of the grinding tool, at which the grinding dust is produced. Preferably, for this purpose, on its side that faces towards the intake opening the grinding tool has suitable intake openings that face towards the intake opening of the dust extraction duct.

In an expedient development of the invention, at its end that faces away from the grinding tool the dust extraction duct has a connection piece for receiving an extraction hose.

In this way, the dust extraction duct can be connected directly to an extraction device, for example a vacuum cleaner.

The object of the invention is further achieved by a dust extraction duct for a grinder, having a flattened pivot for insertion into at least one associated recess, having an insertion slot, on the housing of the grinder, and having a latching element on the dust extraction duct to effect a latching connection to the housing.

In this way, the dust extraction duct can be easily and rapidly fastened to or detached from the grinder without the aid of a tool.

It is understood that the abovementioned features of the invention and those yet to be explained in the following can be applied, not only in the respectively specified combination, but also in other combinations or singly, without departure from the scope of the present invention.

BRIEF DESCRIPTION OF THE DRAWINGS

Exemplary embodiments of the invention are represented in the drawing and explained more fully in the following description. In the drawings.

DETAILED DESCRIPTION OF PREFERRED EMBODIMENTS

Figure 1:
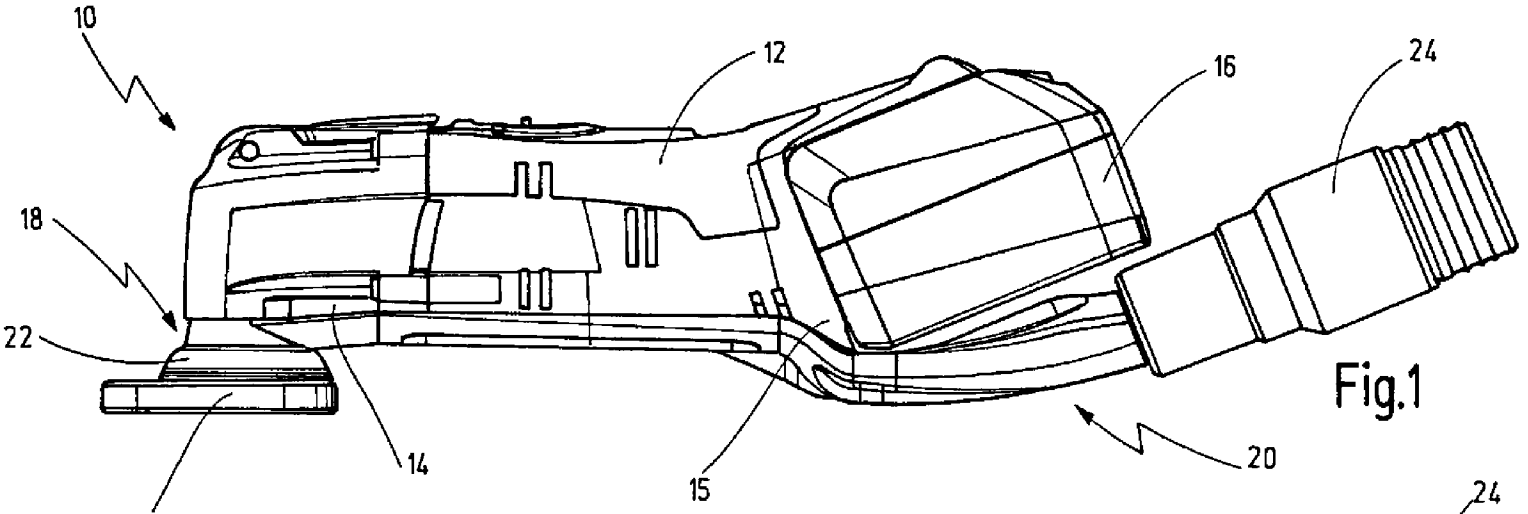
FIG. 1 shows a general view of a grinding tool according to the invention, having a dust extraction duct accommodated on the underside thereof.

A grinder according to the invention is represented in FIG. 1 and denoted as a whole by the numeral 10. The grinder 10 is a grinder driven in an oscillating manner and from whose housing 12 there projects outwardly a grinding spindle, denoted only schematically by the numeral 18 in FIG. 1, to which a grinding tool 19 is fastened in a detachable manner.

The grinding spindle 18 can be swivelled back and forth, in a fundamentally known manner, at a high frequency of, for example, between 5,000 and 25,000 oscillations per minute, and with a small swivel angle in the range from approximately 0.5 to 5° about the grinding spindle 18. As is known, particularly good grinding results can be achieved with such grinders, especially if grinding is to be effected along inner longitudinal edges or in corner regions.

Extending on the underside of the housing i.e. on the side of the housing that faces towards the grinding tool 19, there is a dust extraction duct 20, which, in a first region 14 of the housing 12, in the region of the grinding spindle 18, encloses the latter with an annular intake region 22. The dust extraction duct 20 runs along the underside of the housing 12, as far as a second region 15, at which a battery 16 is accommodated, then runs along the battery 16 and finally opens into a connection piece 24. An extraction hose (not represented) can be connected to the connection piece 24.

The dust extraction duct 20 can be easily fastened to and detached from the housing 12, as explained more fully in the following with reference to FIGS. 2 to 6.

Figure 2:
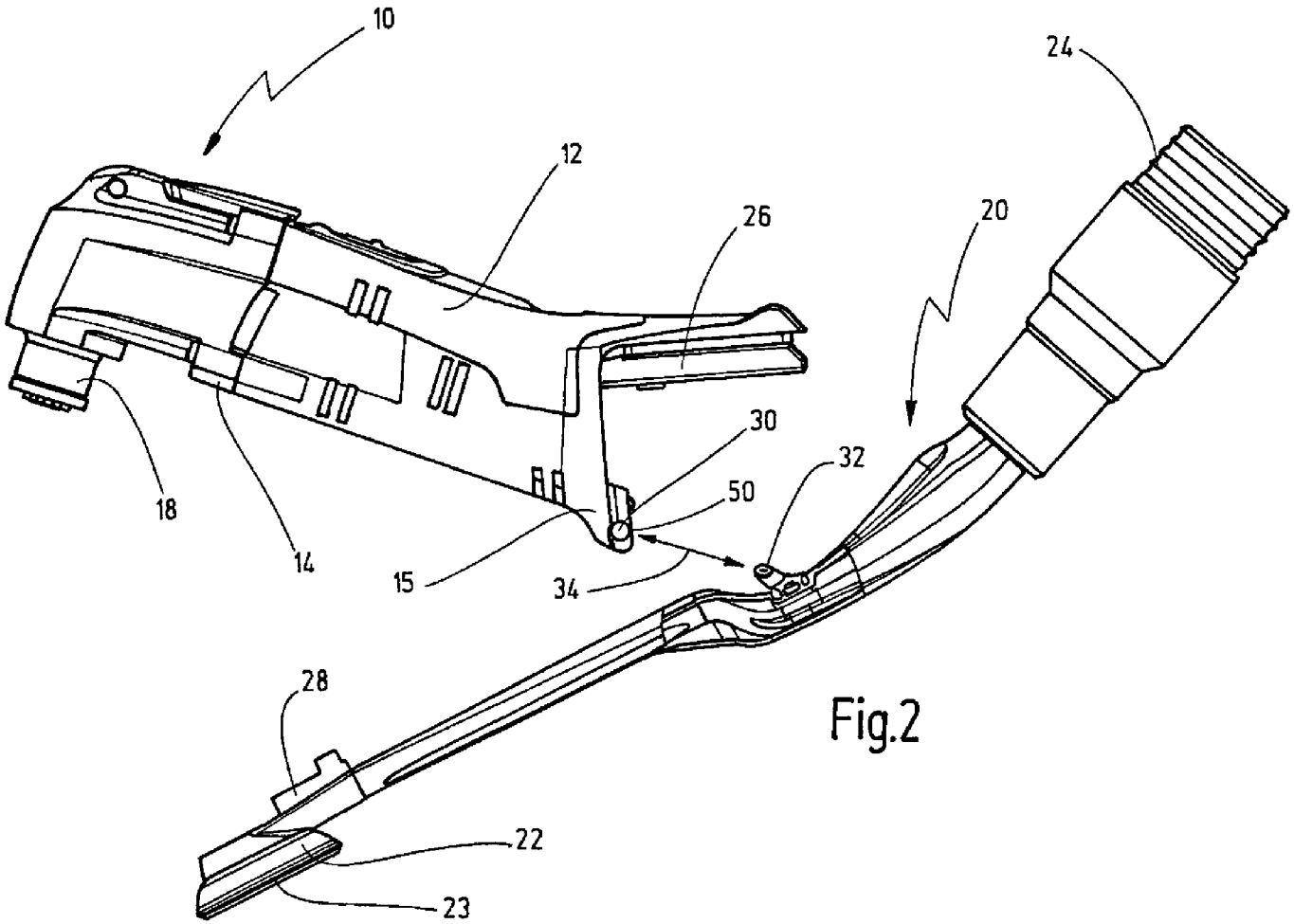
FIG. 2 shows the grinder according to FIG. 1, but after removal of the battery and with the dust extraction duct represented next to the grinder and positioned such that it can be inserted by its pivot, through a slot, into a receiver on the housing.
Figure 4:
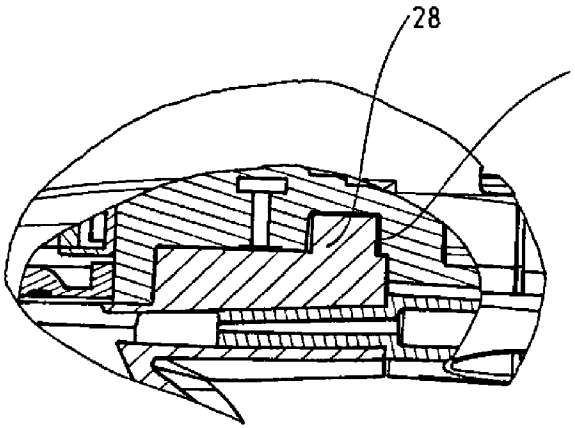
FIG. 4 shows an enlarged representation in the region of the detail IV according to FIG. 3.

As can be seen from FIG. 2, a receiver 26 for fastening the battery 16 is provided on the housing 12, at the end thereof that faces away from the grinding spindle 18. In FIG. 2, the grinding tool 10 is represented after removal of the battery. A pivot joint, for fastening the dust extraction duct 20, is provided in the second region 15 of the housing 12, i.e. on the underside region, at the end that faces away from the grinding spindle 18. The pivot joint is composed of a receiver 30 in the second region 15 of the housing 12 and of an associated pivot 32 on the dust extraction duct 20.

Figure 5:
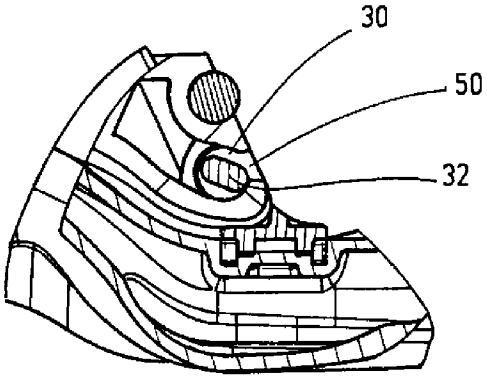
FIG. 5 shows an enlarged representation of the detail V according to FIG. 3.

As can be seen in greater detail from FIG. 2 and, in particular, from FIG. 5, the recess 30 on the housing 12 has an insertion slot 50, through which the associated pivot 32 on the dust extraction duct can be inserted when in a particular position, which is indicated in FIG. 2. Upon the dust extraction duct 20 being moved in the direction of the arrow 34, according to FIG. 2, towards the recess 50, an assembly position is attained, in which the pivot 32 of the dust extraction duct 20 can be inserted through the slot 50 into the recess 30, and can then be swivelled within the recess 30, which is basically cylindrical in form.

Once the pivot 32 has been moved through the slot 50 into the recess 30 and swivelled within the recess 30, it is held captively in the latter. As soon as the pivot 32 has been inserted through the slot 50 into the recess 30, an assembly position is reached, out of which the dust extraction duct 30 can be swivelled, about the thus formed pivot, onto the housing 12.

Figure 3:
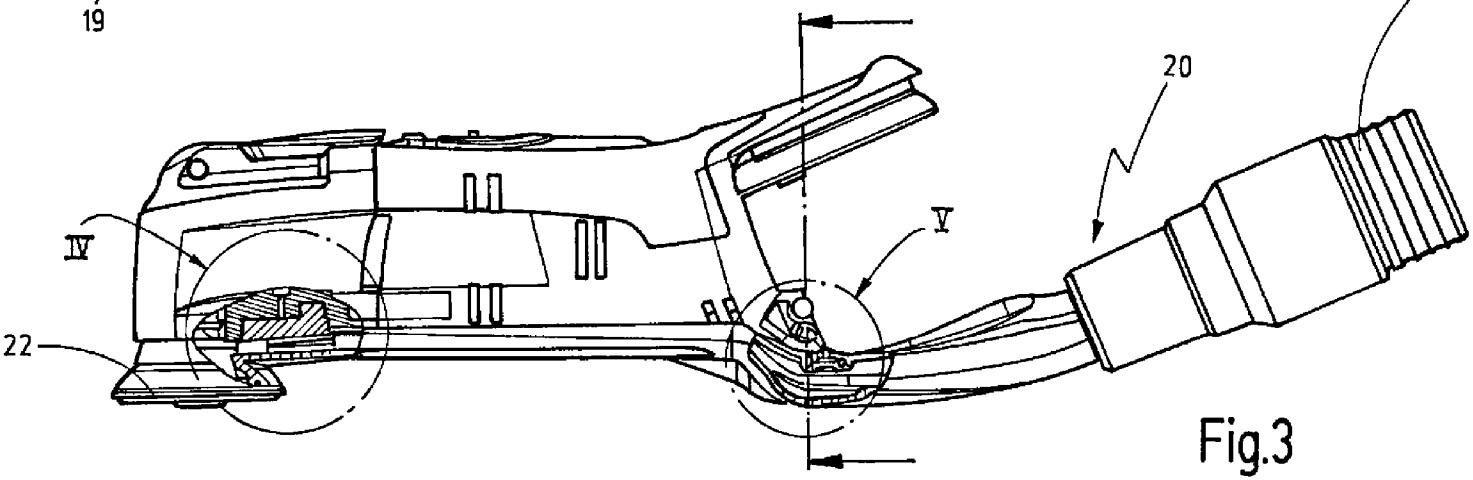
FIG. 3 shows the grinder according to FIG. 2, but after insertion of the pivot joint into the receiver of the housing, into an assembly position, and subsequent swivelling into a working position, in which the dust extraction duct extends along the lower end of the housing and is connected to the housing via a latching connection.

The intake region 22 is thereby moved over the grinding spindle 18 and finally attains a working position, represented in FIG. 3, in which, in the first region 14, the dust extraction duct 20 is locked on the housing 12 by means of a latching connection. When swivelling about the pivot joint 30, 32 has been completed, a latching element 28 located a short distance behind the intake region 22, on the side that faces towards the housing 12, goes into a corresponding latching receiver 40 (cf. FIG. 4, on the housing 12) and latches therein.

Fastening to the housing 12 can thus be effected in a simple and secure manner. After a suitable release means (not represented) in the region of the latching receiver 40 has been pressed, the latching element 28 can be released again from the housing 12, and the dust extraction duct 20 can be swivelled back into its assembly position and finally removed from the housing 12.

Figure 6:
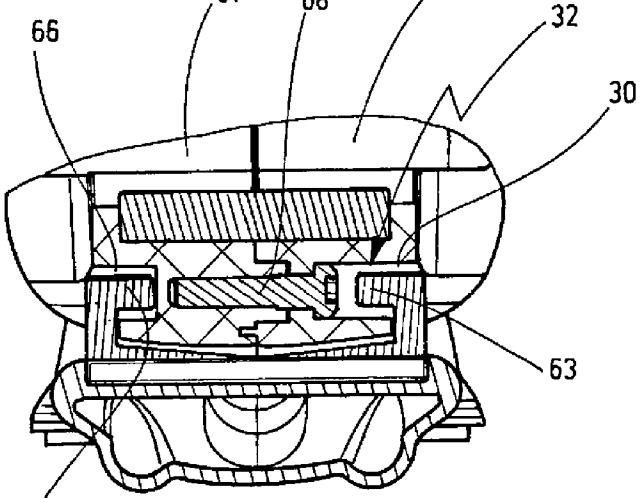
FIG. 6 shows an enlarged partial cross-section through the grinder in the region of its pivot joint.

The housing 12 is divided in the longitudinal direction into two housing halves 60, 61, as can be seen from FIG. 6. FIG. 6 shows an enlarged section through the pivot joint. FIG. 2 and FIG. 5 show only one recess 30, in which the pivot 32 engages. As can be seen from FIG. 6, however, a recess 30, 66 is provided on each housing half 60, 61, such that there are two mutually opposite recesses, in each of which there engages a respective pin 63, 64, constituting the pivot 32. As explained previously, both pins 63, 64 have a flat cross-section (cf. FIG. 5), such that insertion can be effected in the radial direction of the associated recesses 30, 66 through the slot (only one represented in FIG. 5, denoted by numeral 50).

The one recess 30 is also additionally used to receive a screw 68, which can be inserted through the recess 30 in the axial direction and screwed into the other housing half 61, in order thus to connect the two housing halves 60, 61 to one another by a screwed connection in this region.

In this way, the thus formed pivot can easily be integrated into the housing 12 and coupled to the screwed connection in this region.

The grinding tool 19 can only be mounted and demounted at the outer end of the grinding spindle either when the dust extraction duct 20 has been fully removed or when the dust extraction duct 20 is in the working position and latched.

Thus, for example, if a grinder 10 previously operated without a dust extraction duct 20 is now to be operated with a dust extraction duct, the battery 16 must first be removed from the housing 12, and a possibly mounted grinding tool 19 must likewise be removed from the grinding spindle 18. Then, as represented in FIG. 2, the dust extraction duct 20 can be inserted, by its pivot 32, through the slot 50, into the recess 30, and thus brought into its assembly position. In that position, this is followed by swivelling until the latching element 28 latches in at the latching receiver 40. After fastening of the dust extraction duct 20 has been completed, the grinding tool 19 can then be fastened to the outer end of the grinding spindle 18, preferably by means of a suitable quick-release connection.

What is claimed is:

1. A grinder, comprising:

a grinding spindle configured for attaching a grinding tool;

a housing having a first region facing towards the grinding spindle and having a second region faces away from said grinding spindle;

a dust extraction duct;

a first releasable connection between said housing and said dust extraction part allowing securing of said dust extraction part to said housing when being in a working position and allowing removal of said dust extraction part when being in an assembly position; and a second releasable connection cooperating with said first releasable connection;

wherein said first releasable connection comprises a pivot joint;

and wherein said second releasable connection is configured for latching said dust extraction duct to said housing when being in said working position;

wherein said first releasable connection comprises a substantially cylindrical recess, into which a flat pivot can be inserted, said recess comprising a lateral insertion slot cooperating with said flat pivot so as to allow inserting of said pivot through said insertion slot into said recess when being in said assembly position, and to allow pivoting said flat pivot within said recess for swivelling said dust extraction duct from said assembly position into said working position.

2. The grinder of claim 1, wherein said recess is arranged in said second region of the housing, and wherein said pivot is arranged on said dust extraction duct.

3. The grinder of claim 1, wherein said first releasable connection comprises a first recess, into which a first pivot can be inserted, and further comprises a second recess, into which a second pivot can be inserted.

4. The grinder of claim 3, wherein said first and second recesses are provided opposite one another on said second region of said housing, and wherein said first and second pivots are configured as pins which can be inserted into said first and second recesses.

5. The grinder of claim 4, wherein said housing is divided in a longitudinal direction into a first housing half and a second housing half, and wherein said first recess is arranged on a first one of said first and second housing halves, and wherein said second recess is arranged opposite said first recess on another one of said first and second housing halves.

6. The grinder of claim 5, further comprising a screwed connection securing said first and second housing halves and being arranged in an axial direction of said pivot joint.

7. The grinder of claim 6, wherein said latching connection cooperates with said first releasable connection so as to allow latching of said dust extraction duct to said housing upon swivelling from said assembly position into said working position.

8. The grinder of claim 1, wherein said dust extraction duct comprises an intake region surrounding said grinding spindle.

9. The grinder of claim 8, wherein dust extraction duct comprises an annular intake opening facing towards said grinding spindle.

10. The grinder of claim 1, wherein said dust extraction duct has an end facing away from said grinding tool, and wherein said dust extraction duct further comprises a connection piece arranged on said end for receiving an extraction hose.

11. A grinder, comprising:

a grinding spindle configured for attaching a grinding tool;

a housing having a first region that facing towards the grinding spindle and having a second region faces away from said grinding spindle;

a dust extraction duct; and a first releasable connection between said housing and said dust extraction part allowing securing of said dust extraction part to said housing when being in a first position and allowing removal of said dust extraction part when being in a second position;

wherein said first releasable connection comprises a pivot joint comprising a recess, into which a flat pivot can be inserted, said recess comprising a lateral insertion slot cooperating with said flat pivot so as to allow inserting of said pivot through said insertion slot into said recess when being in said second position, and to allow pivoting said flat pivot within said recess for swivelling said dust extraction duct from said second position into said first position.

12. The grinder of claim 11, wherein said releasable connection further comprises a second releasable connection cooperating with said first releasable connection.

13. The grinder of claim 12, wherein said second releasable connection is configured as a latching connection.

14. A dust extraction duct in a grinder comprising:

a grinding spindle configured for attaching a grinding tool;

a housing having a first region that facing towards the grinding spindle and having a second region faces away from said grinding spindle;

a dust extraction duct; and a first releasable connection between said housing and said dust extraction part allowing securing of said dust extraction part to said housing when being in a first position and allowing removal of said dust extraction part when being in a second position; and a second releasable connection cooperating with said first releasable connection;

wherein said first releasable connection comprises a pivot joint having a flattened pivot cooperating with a recess allowing rotation of said flattened pivot therein and with an insertion slot allowing insertion of said flattened pivot into said recess, and wherein said second releasable connection comprises a latching element configured for latching said dust extraction duct to said housing.

* * * * *